United States Patent [19]

Steward

[11] 4,034,272

[45] July 5, 1977

[54] MOVING SCREEN ARRANGEMENT

[76] Inventor: John M. Steward, Grizzly Flat Road, Somerset, Calif. 95684

[22] Filed: July 7, 1975

[21] Appl. No.: 593,870

[52] U.S. Cl. ..... 318/7; 318/63; 318/86

[51] Int. Cl.[2] ..... B65H 77/00

[58] Field of Search ..... 318/7, 6, 57, 63, 67, 318/86

[56] References Cited

UNITED STATES PATENTS

| | | | |
|---|---|---|---|
| 3,498,570 | 3/1970 | Scholfield | 318/7 X |
| 3,501,682 | 3/1970 | Jacoby | 318/7 |
| 3,704,401 | 11/1972 | Miller | 318/7 |
| 3,715,641 | 2/1973 | Mattes | 318/7 |
| 3,863,117 | 1/1975 | Paschetto | 318/7 |

*Primary Examiner*—B. Dobeck
*Attorney, Agent, or Firm*—Harris Zimmerman

[57] ABSTRACT

A moving screen display device includes a display web supported on a pair of reels, and a reversible motor to drive each reel. The motors are selectively driven so that if one motor is driving one reel in a take-up direction, the other motor is driven in the same direction at a reduced voltage to relieve stress on its drive train. To stop the web at a desired display position, the driving motor is deenergized, and the other motor is simultaneously driven for a few seconds in a reverse direction at a reduced voltage to counteract the momentum of the system.

2 Claims, 1 Drawing Figure

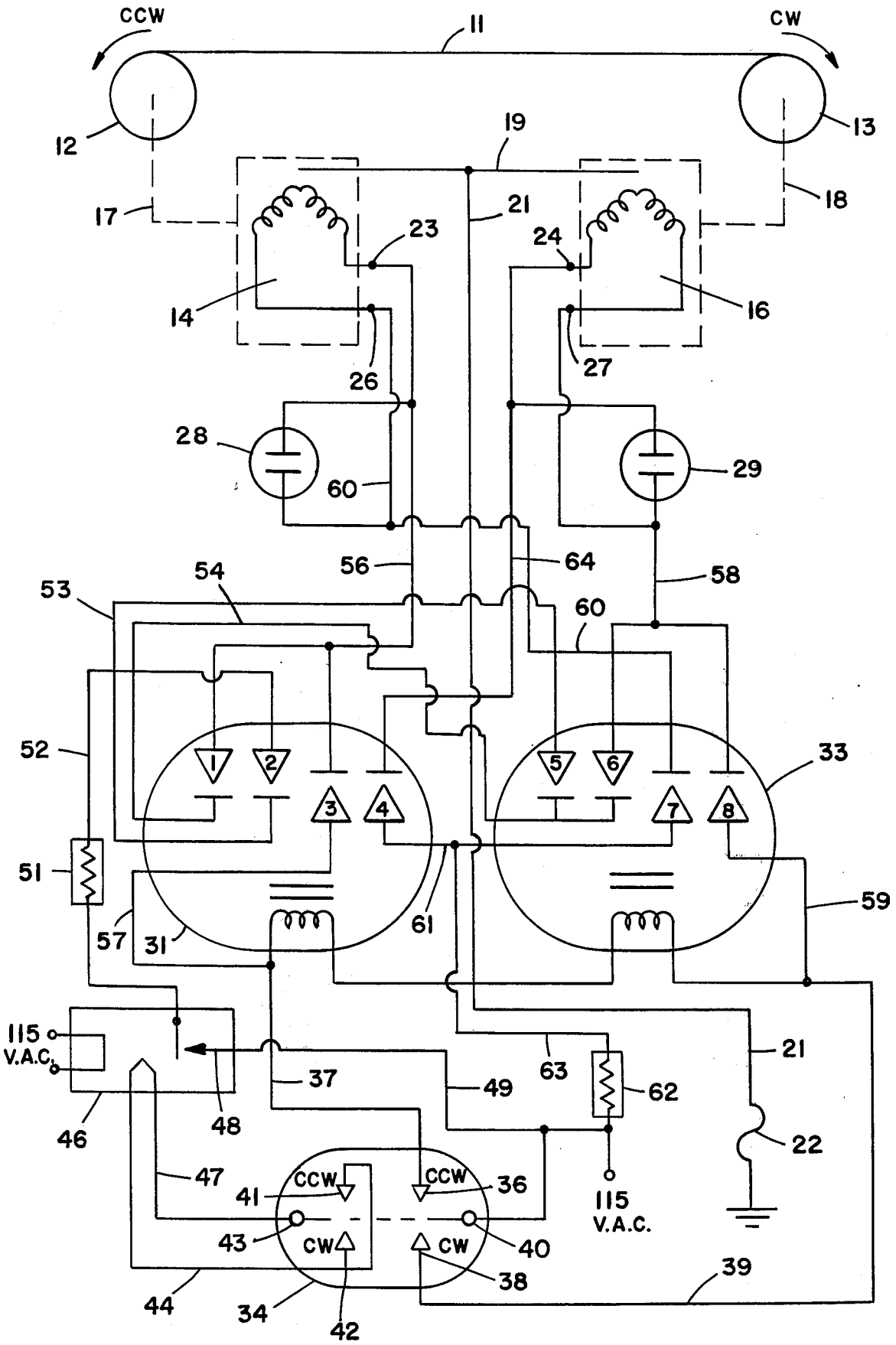
CCW
CW
11
12
13
19
17
18
21
23
24
14
16
26
27
28
29
60
56
64
58
54
53
60
52
33
51
59
57
31
61
115
V.A.C.
21
37
49
63
62
46
48
22
47
41
CCW
CCW
36
43
CW
CW
40
38
115
V.A.C.
44
34
42
39

MOVING SCREEN ARRANGEMENT

BACKGROUND OF THE INVENTION

There are many devices known in the prior art for supporting and translating a display web across a display screen or viewing surface. Such devices usually consist of a pair of reels on which the web is wound, and at least one controlled motor for driving the reels, often through a gear reduction train. In some systems one motor is used to drive each reel, so that the web direction may be reversed, either reel serving as a take-up reel.

In two motor systems, only one motor is actuated to drive the web at any given time, the other motor being idle. However, without the use of a clutch mechanism in the drive link between the motor and the reel, the idle motor will be turned by working motor through the translation of the web driving the supply reel and the associated gear train. Gear reduction systems generally are not adapted for such idling, and will deteriorate quickly under this sort of misuse. Clutch mechanisms, on the other hand, entail added cost as well as requiring frequent maintenance.

In display web systems it is often desirable or necessary to translate the web to a specific display position and stop the web exactly at this position. This proves to be a difficult achievement, due to the momentum of the motors, reels, and web. Often braking mechanisms are employed to counteract the momentum, although these mechanisms are costly. Alternatively, the motor is stopped with the web slightly short of the desired position, and the momentum is permitted to carry the web to the desired position. This method is approximate and often frustrating, as the momentum depends on a number of variable factors; i.e., the mass of the web on each reel, the speed of the reels and web at the instant of motor de-actuation, etc.

SUMMARY OF THE INVENTION

The present invention generally comprises a display web transport system which eliminates the need for clutch mechanisms and braking systems, yet which outperforms transport systems using such devices. The system includes a pair of reels, each driven by a reversible motor, and a display web wound on the reels. The motors are actuated by a manual switch through a relay system so that when one motor is driving its associated reel in a take-up direction, the other motor is driven with a reduced voltage in the same direction, to relieve the stress on the gear reduction system.

To stop the system, the manual switch is released, actuating a time-delay relay. The time-delay relay maintains actuation of the take-up reel driving motor, and also applies a reduced voltage in the reverse direction to the "idle" motor. This reverse actuation counteracts the momentum of the system, stopping the display web exactly in its position at the moment of switch release. This reverse actuation is maintained for a few seconds, until the time-delay relay deactivates and turns off both motors.

THE DRAWING

The FIGURE is a schematic representation of the electronic control system of the present invention.

DESCRIPTION OF THE PREFERRED EMBODIMENT

With reference to the accompanying drawing, the present invention generally is directed toward a transport system for a display web 11 which is wound on a pair of rollers 12 and 13. Each roller is driven by a split capacitor motor 14 and 16, respectively. Each motor is connected to its associated roller through a drive link 17 and 18, which may comprise a gear reduction system, a belt drive, friction drive, or other similar means well known in the art. The common terminals of each motor are connected together by conductor 19, which is connected to ground through conductor 21 and fuse 22.

Each motor 14 and 16 includes a terminal 23 and 24, respectively, which may be energized for counterclockwise rotation, and a terminal 26 and 27 for clockwise rotation. A starting capacitor 28 is connected between terminals 23 and 26, and a starting capacitor 29 is connected between terminals 24 and 27.

The motors are controlled by two relays 31 and 33, each having a four pole, double throw configuration. The relays, in turn, are actuated by a manual switch 34, which is a four pole, double throw switch with a neutral center position. Contact 36 of switch 34 is connected through line 37 to the coil of relay 31. Contact 38 of switch 34 is connected through line 39 to the coil of relay 33. The contact wiper 40 is connected to the 115V AC power supply. Both coils are connected to ground through line 21.

Contacts 41 and 42 of switch 34 are wired together, and are connected through line 44 to the trigger of an adjustable time relay 46. Line 47 connects the return of the trigger to the contact wiper 43. The time delay relay 46 is driven by a 115V AC power supply, and includes a normally open contact pair 48, one of which is connected to the 115V AC supply through line 49. The other contact of pair 48 is connected to dropping resistor 51, which provides approximately 75 volts through line 52 to one of the normally closed contacts 2 of relay 31. The other side of contacts 2 is connected by line 53 to one side of normally closed contacts 5 and 6 of relay 33.

The other side of contacts 5 is connected by line 54 to one of the normally closed contacts 1. The other side of contacts 1 is connected by line 56 to one of the normally open contacts 3, and to terminal 23 of motor 14. The other side of contacts 3 is joined to line 37 through line 57.

One of the normally closed contacts 6 is connected to one of the normally open contacts 8, and to line 58 which leads to terminal 27 of motor 16. The other side of contacts 8 is connected to line 39 through line 59. One side of normally open contacts 7 is connected to one of the normally open contacts 4 by line 61. The other side of contacts 7 is connected by line 60 to terminal 26 of motor 14. The 115V AC supply is connected to a dropping resistor 62, which provides approximately 50 volts to conductor 63, which is connected to line 61. The other side of contacts 4 is connected by line 64 to terminal 24 of motor 16.

OPERATION OF THE PREFERRED EMBODIMENT

To rotate wheel 12 in a counterclockwise direction and transport the web toward reel 12, the manual switch 34 is operated in the CCW direction, closing contacts 36 and 40, and contacts 41 and 43. Power is fed through the former pair and through line 37 to operate relay 31. Contact pairs 1 and 2 open, and 3 and 4 close. The 115V AC power supply is thus connected by line 57, contacts 3, and line 56 to contact 23 of motor 14, causing it to rotate and drive the reel 12 counterclockwise. At the same time, the 50 volts of the dropping resistor 62 is applied through line 63, closed contact pair 4, and line 64 to contact 24 of motor 16. This reduced voltage is insufficient to drive motor 16 in the counterclockwise direction, but it does cause the motor to generate sufficient torque to allow the drive linkage 18 to turn freely as the reel 13 is rotated by the translating web.

The closure of contacts 41 and 42 triggers the time-delay relay 46, causing contacts 48 to close. The supply voltage is fed through line 49, and contacts 48 to dropping resistor 51. The 90 volts from resistor 51 is fed through line 52 to contact pair 2, which are open when switch 34 is engaged in the CCW position. As switch 34 is released to the neutral position, as when the desired display is properly positioned by the web 11, the relay 31 is de-activated, while relay 46 delays before opening. Thus 90 volts is applied through closed contact pair 2, line 53, contact pairs 5 and 6, and line 58 to contact 27 of motor 16, causing it to reverse and rotate in the clockwise direction with reduced torque.

At the same time the 90 volt potential is fed through contact pair 5, line 54, contact pair 1, and line 56 to contact 23 of motor 14, causing it to continue to rotate in the counterclockwise direction with reduced torque. The motors are thus rotating in opposition to each other, immobilizing the display web and neutralizing any momentum of the system. The web is thus caused to stop exactly in its position at the instant the switch 34 is released. After a few seconds the time-delay relay opens, and the entire system returns to a quiescent state.

To transport the web in the opposite direction, exactly the opposite process takes place. Switch 34 is manually engaged in the CW position, closing contacts 38 and 40 to connect the coil of relay 33 to the power supply through line 39. Contacts 5 and 6 open, and contacts 7 and 8 close. Contacts 42 and 43 of manual switch are also closed, triggering the time-delay relay 46. Power is conducted through line 59 and closed contacts 8 to line 58 and contact 27 of motor 16, causing the motor to drive the reel 13 clockwise. At the same time 50 volts from resistor 62 is fed through closed contacts 7 and line 60 to contact 26 of motor 14, torque-biasing the motor in the direction of the web transport.

As before, the release of switch 34 de-activates relay 33, closing contacts 5 and 6 and opening contacts 7 and 8. Actuation of relay 46 is maintained, providing 90 volts from dropping resistor 51 through contacts 2, line 53, contacts 5 and 6, and line 58 to bias motor 16 in the clockwise direction. The same 90 volts is applied to contact 23 of motor 14 to bias the motor counterclockwise, stopping the system as explained in the foregoing. When the relay 46 times out, the system returns to the quiescent state.

It should be emphasized that the present invention achieves the transport of the web without requiring clutch mechanisms, and is able to stop the web exactly in a desired disposition without the use of braking devices. Such an achievement represents a significant advance in the field of web transport systems.

I claim:

1. A web transport system comprising a pair of reels for supporting, storing and displaying a web therebetween, a pair of reversible electric motors each operatively connected to one of said reels, relay means including a pair of relays for applying a first voltage to one of said motors to drive said one motor in a first rotational direction, and for applying a second, reduced voltage to the other of said motors to torque bias said other motor in said first rotational direction, and stopping means for applying a third, reduced voltage to said one motor to drive said one motor in said first direction while applying said first voltage in reverse fashion to said other motor to drive said other motor counter to said first direction and stop said reels, said stopping means including a manual switch and a time delay relay, said manual switch including a neutral, non-actuating position, a first position for actuating said relay means to apply said first and second voltages to said motors, and a second position for actuating said time delay relay and said relay means to apply said third voltage to said motors.

2. The web transport system of claim 1, wherein said time delay relay remains actuated for a brief period after said switch is returned to said neutral position from said first or second positions to maintain application of said third voltage to said motors and stop said system.

* * * * *